US012108832B2

(12) United States Patent
Bessho et al.

(10) Patent No.: US 12,108,832 B2
(45) Date of Patent: Oct. 8, 2024

(54) SHOE, AND METHOD FOR PRODUCING SHOE

(71) Applicant: ASICS CORPORATION, Kobe (JP)

(72) Inventors: Ayu Bessho, Kobe (JP); Satoru Abe, Kobe (JP); Norihiko Taniguchi, Kobe (JP)

(73) Assignee: ASICS CORPORATION, Kobe (JP)

( * ) Notice: Subject to any disclaimer, the term of this patent is extended or adjusted under 35 U.S.C. 154(b) by 0 days.

(21) Appl. No.: 16/959,123

(22) PCT Filed: Sep. 30, 2019

(86) PCT No.: PCT/JP2019/038481
§ 371 (c)(1),
(2) Date: Jun. 29, 2020

(87) PCT Pub. No.: WO2021/064782
PCT Pub. Date: Apr. 8, 2021

(65) Prior Publication Data
US 2022/0000219 A1 Jan. 6, 2022

(51) Int. Cl.
*A43B 23/04* (2006.01)
*A43B 1/14* (2006.01)
(Continued)

(52) U.S. Cl.
CPC ..... *A43B 23/042* (2013.01); *A43B 1/14* (2013.01); *A43B 23/0235* (2013.01); *A43B 23/025* (2013.01); *A43D 3/1408* (2013.01)

(58) Field of Classification Search
CPC ... A43B 1/04; A43B 23/0205; A43B 23/0225; A43B 23/0235; A43B 23/026; D04B 1/26; D04B 1/265
See application file for complete search history.

(56) References Cited

U.S. PATENT DOCUMENTS 2,995,838 A * 8/1961 Servin ..... A43B 3/101 36/9 R
4,133,191 A * 1/1979 Blore ..... D04B 1/08 28/163
(Continued)

FOREIGN PATENT DOCUMENTS

JP 2006-511306 A 4/2006
JP 2014-210176 A 11/2014
(Continued)

OTHER PUBLICATIONS

Written Opinion of the International Searching Authority issued in PCT/JP2019/038481; mailed Jul. 27, 2020.
(Continued)

*Primary Examiner* — Megan E Lynch
(74) *Attorney, Agent, or Firm* — Studebaker & Brackett PC

(57) ABSTRACT

A shoe including: an upper that includes a first layer made of knitted fabric and a second layer made of knitted fabric arranged inside the first layer, wherein at least one of the first layer and the second layer includes first yarns and second yarns as yarns for forming the knitted fabric, wherein the first yarns have a heat shrinkability, wherein the second yarns have a higher fusion point than that of the first yarns, and wherein the at least one of the first layer and the second layer including the first yarns and the second yarns has a higher heat shrinkage rate in a width direction than in a longitudinal direction.

19 Claims, 13 Drawing Sheets

(51) Int. Cl.
*A43B 23/02* (2006.01)
*A43D 3/14* (2006.01)

(56) References Cited

U.S. PATENT DOCUMENTS 4,891,958 A * 1/1990 Cournoyer ..... D04B 1/104 66/196
8,701,232 B1 * 4/2014 Droege ..... A43C 1/00 12/142 R
10,194,711 B2 2/2019 Dua et al.
2004/0118018 A1 6/2004 Dua
2005/0016023 A1 * 1/2005 Burris ..... B29D 35/146 36/55
2005/0193592 A1 * 9/2005 Dua ..... A43D 8/00 36/45
2006/0223400 A1 * 10/2006 Yasui ..... D04B 1/16 442/304
2008/0250668 A1 * 10/2008 Marvin ..... A43B 23/0245 36/50.1
2012/0279260 A1 * 11/2012 Dua ..... A43B 1/04 66/171
2013/0269209 A1 * 10/2013 Lang ..... A43B 23/0205 12/146 C
2014/0310983 A1 * 10/2014 Tamm ..... A43B 23/0235 36/83
2014/0352173 A1 * 12/2014 Bell ..... D04B 1/102 28/165
2015/0107307 A1 * 4/2015 Kosui ..... D04B 1/26 2/239
2015/0216253 A1 * 8/2015 Podhajny ..... A43B 1/04 28/165
2015/0223552 A1 8/2015 Love et al.
2015/0351483 A1 * 12/2015 Podhajny ..... A43B 1/04 66/202
2017/0042280 A1 2/2017 Bacino et al.
2017/0325546 A1 11/2017 Becker et al.
2018/0125165 A1 5/2018 Adami et al.
2018/0368524 A1 12/2018 Taniguchi et al.
2019/0069635 A1 * 3/2019 Lang ..... D04B 1/16
2019/0261731 A1 8/2019 Bacino et al.
2020/0022456 A1 * 1/2020 Brinkman ..... A43B 1/04
2020/0029647 A1 * 1/2020 Unnewehr ..... D04B 1/26
2020/0337409 A1 * 10/2020 Filteau ..... B32B 5/245
2020/0391476 A1 * 12/2020 Rezab ..... B32B 5/26
2021/0030101 A1 * 2/2021 Bruner ..... A43B 1/14
2021/0244137 A1 * 8/2021 Zhu ..... B32B 7/14

FOREIGN PATENT DOCUMENTS

WO 2013/108506 A1 7/2013
WO 2017/115805 A1 7/2017
WO 2017/115806 A1 7/2017

OTHER PUBLICATIONS

The extended European search report issued by the European Patent Office on Nov. 17, 2020, which corresponds to European U.S. Appl. No. 16/959,123-1011 and is related to U.S. Appl. No. 16/959,123.
Notification of Transmittal of Copies of Translation of the International Preliminary Report on Patentability and Translation of Written Opinion of the International Searching Authority; PCT/JP2019/038481; mailed on Apr. 14, 2022.
An Office Action mailed by China National Intellectual Property Administration on Jan. 2, 2024, which corresponds to Chinese Patent Application No. 201980006144.9 and is related to U.S. Appl. No. 16/959,123; with English language translation.
Communication pursuant to Article 94(3) EPC issued by the European Patent Office on Dec. 20, 2023, which corresponds to European Patent Application No. 19897567.4-1015 and is related to U.S. Appl. No. 16/959,123.

* cited by examiner

SHOE, AND METHOD FOR PRODUCING SHOE

FIELD

The present invention relates to a shoe including a fabric upper, and a method for producing the shoe.

BACKGROUND

When a shoe is produced, a last (shoe last), on which fabric for forming an upper is placed, is used to, for example, form the upper into a certain shape.

CITATION LIST

Patent Literature

Patent Literature 1: US 2017/325546 A
Patent Literature 2: US 2018/125165 A
Patent Literature 3: WO 2017/115806 A
Patent Literature 4: WO 2013/108506 A

SUMMARY

Technical Problem

When an upper is shaped, it is important to conform the upper to a shape of a last. Specifically, in the case where the last has a shape taken from the shape of a foot of an ordering person, conforming the upper to the shape of the last is important in making the last well conform to the shape of the foot of the ordering person and thereby applying such a last for customization. For the last for mass produced shoes, conforming the upper to the shape of the last is important in eliminating variation in shape of the mass produced shoes. Regarding these important aspects, for example, if the upper is shaped with a gap relative to the surface of the last on a lateral side of the foot, the shoe would lack the ability of holding the foot of the wearer since the foot moves toward the lateral side during the wearing of the shoe. The thus caused gap may be filled with stuffing or the like, but the feeling of wearing may be deteriorated.

US 2017/325546 A discloses an upper that expands in a molding die. US 2018/125165 A discloses thermoforming for fabric. WO 2017/115806 A discloses a shoe upper material using a fiber sheet having a heat shrinkability. WO 2013/108506 discloses a knitted fabric using heat fusible yarns and being excellent in shape retention ability.

An object of the present invention is to provide a shoe including an upper that is easily conformed to a shape of a last when the upper is shaped, and a method for producing the shoe.

Solution to Problem

A shoe including: an upper that includes a first layer made of knitted fabric and a second layer made of knitted fabric arranged inside the first layer, wherein at least one of the first layer and the second layer includes first yarns and second yarns as yarns for forming the knitted fabric, wherein the first yarns have a heat shrinkability, wherein the second yarns have a higher fusion point than that of the first yarns, and wherein the at least one of the first layer and the second layer including the first yarns and the second yarns has a higher heat shrinkage rate in a width direction than in a longitudinal direction.

A method for producing a shoe that is the shoe according to claim 1, the method including: a joining step of joining the first layer and the second layer at least along outer edges of the first layer and the second layer to make an unshaped upper; a first shaping step of placing the unshaped upper on a last; and a second shaping step of heating the unshaped upper to make it conform to a shape of the last to thereby provide the shaped upper.

DESCRIPTION OF EMBODIMENTS

Figure 1:
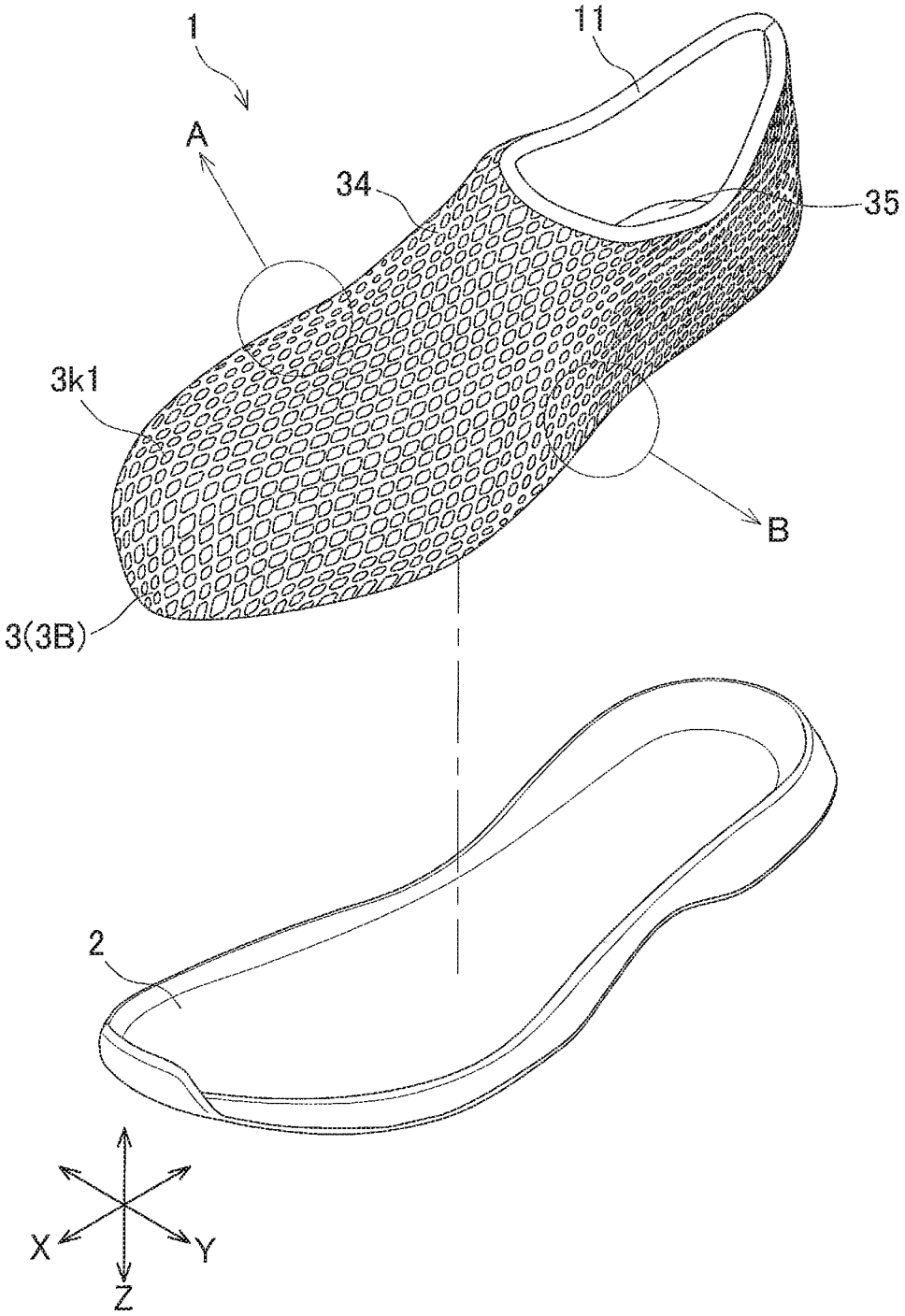
FIG. 1 is an exploded perspective view of a sole and an upper of a shoe according to one embodiment of the present invention.
Figure 2A:
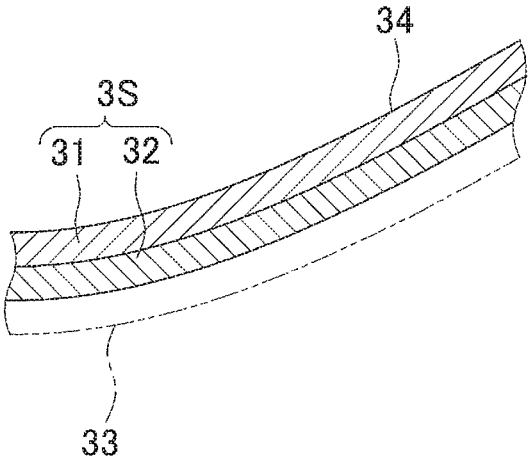
FIG. 2A is a cross-sectional view showing an example of a layer structure of a body portion of the upper in a portion surrounded by circle A in FIG. 1.

The present invention will be described by way of embodiments with reference to the drawings. Each of the right and left shoes 1 of this embodiment mainly includes a sole 2 and an upper 3, and the upper 3 is attached to the sole 2 as shown in FIG. 1. The upper 3 has an at least two layer structure, and includes, as shown in FIG. 2A, a first layer 31 having a sheet shape and a second layer 32 having a sheet shape layered on the first layer 31. The upper 3 in the process of the production (before or after the upper 3 is given a shape) may be also referred to as an unshaped upper 3A or a shaped upper 3B for identification of a separate state.

Figure 4A:
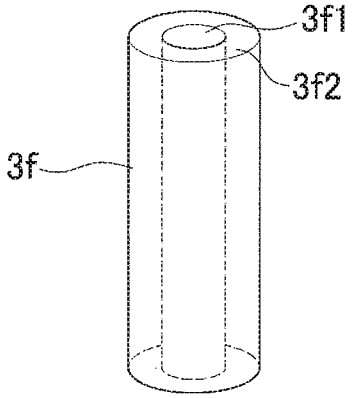
FIG. 4A is a perspective view schematically showing a structure of a yarn made of a core-sheath material.
Figure 4B:
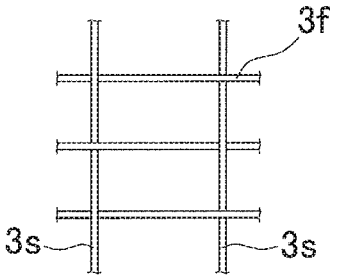
FIG. 4B is a schematic view showing the original state of fabric.

The first layer 31 includes first yarns 3*f* having a heat shrinkability and second yarns 3*s* having a higher fusion point than that of the first yarns 3*f* (specifically, the fusion point of a sheath 3*f*2 in the first yarns 3*f* made of a core-sheath material shown in FIG. 4A). The second yarns have no heat shrinkability or a lower heat shrinkage rate than that of the first yarns 3*f*. In this embodiment, the fusion point of the first yarns 3*f* is 150° C. and the fusion point of the second yarns 3*s* is 230° C. (these values are merely examples without limitation thereto). Regarding the heat shrinkability of each of the yarns 3*f*, 3*s*, the heat shrinkage rate of the first yarns 3*f* is two times or more the heat shrinkage rate of the second yarns 3*s*. In this embodiment, the heat shrinkage rate (the maximum value) of the first yarns 3*f* is 40% and the heat shrinkage rate (the maximum value) of the second yarns 3*s* is 10% (these values are merely examples without limitation thereto). These heat shrinkage rates respectively are those in the longitudinal direction of the yarns 3*f*, 3*s*. The ratio of the heat shrinkage rate of the first yarns 3*f* to the heat shrinkage rate of the second yarns 3*s* can be appropriately set to be two times or more, so that the upper 3 can be easily shaped by heating.

Figure 3A:
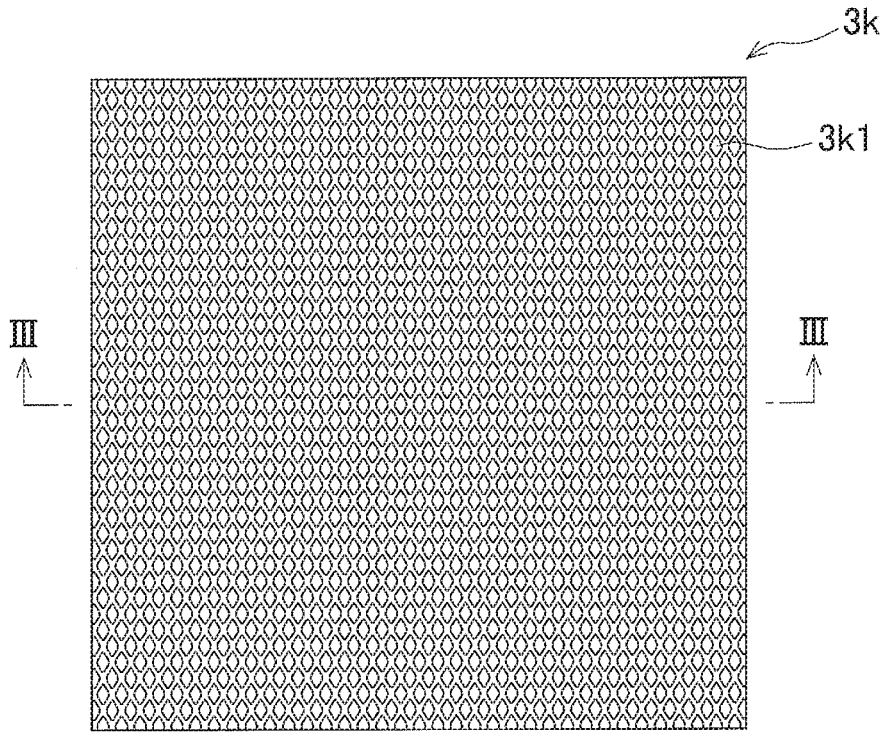
FIG. 3A is a plan view showing an example of double raschel fabric.
Figure 3A:
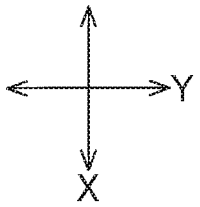
Figure 3B:
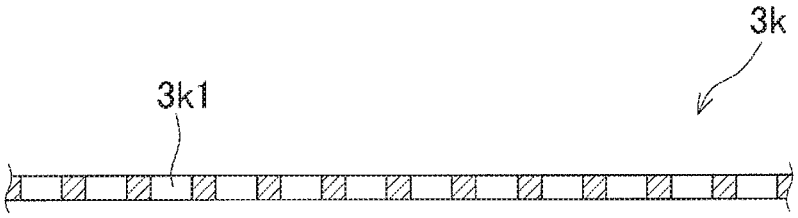
FIG. 3B is a schematic partial enlarged cross-sectional view as viewed from the arrows III-III.

The first layer 31 is made of knitted fabric 3*k* that is formed by knitting yarns with certain gaps 3*k*1 opening through a surface (an outer surface when it is arranged in the shaped upper 3) (see FIG. 3A and FIG. 3B). The gaps 3*k*1 are spaces each existing between the rows of fibers composed of, for example, the yarns 3*f*, 3*s* that form the knitted fabric 3*k* having a mesh structure. Also, the gaps 3*k*1 are spaces each extending through in the normal direction of the plane in which the knitted fabric extends, or spaces in bottomed recesses having opening in the normal direction. In the gaps 3*k*1, the openings of the mesh in the surface of the knitted fabric 3*k* sometimes appear like windows. The shape of the opening is, for example, a circle shape, an oval shape, an elliptical shape, a square shape with rounded corners, or a rhombus shape (see FIG. 1 and FIG. 3A).

On the other hand, the second layer 32 may be made of knitted fabric having no gaps, but preferably made of knitted fabric 3*k* having gaps 3*k*1 in the same manner as the first layer 31. The knitting method of the knitted fabric is not specifically limited, but may be raschel knitting or tricot knitting, for example. The knitting method of the knitted fabric in this embodiment is double raschel knitting. FIG. 3A is a plan view of the knitted fabric 3*k* in a flat state. The knitted fabric 3*k* has a cross-sectional shape as schematically shown in FIG. 3B, through which the gaps 3*k*1 extend in the thickness direction. At least the first layer 31 is made of the knitted fabric 3*k* having gaps 3*k*1 to thereby provide spaces, which can impart breathability and flexibility to the upper 3. Further, the gaps 3*k*1 serve as margins to shrink when the upper 3 is shaped by heating, and therefore margins to shrink are reliably provided in the upper 3 (the unshaped upper 3A). By thus providing a layer (the first layer 31 in this embodiment) including the first yarns 3*f* having a heat shrinkability, the layer (the first layer 31) including the first yarns 3*f* and the second yarns 3*s* is easily deformed when the upper 3 is shaped by heating. Thus, the upper 3 can be easily conformed to the shape of the last 4.

The first layer 31 has a higher heat shrinkage rate in the width direction Y (see FIG. 1) of the upper 3 than in the longitudinal direction X (see FIG. 1). Here, the "heat shrinkage rate" is evaluated by the average value in the direction X and the average value in the direction Y, of the entirety of the first layer 31. The longitudinal direction X is a direction in which a virtual line connecting an extreme toe end of the upper 3 and an extreme heel end extends. The width direction Y is a horizontal direction and is a direction orthogonal to the longitudinal direction X. The dimension of the gaps 3*k*1 included in the knitted fabric 3*k* that forms the first layer 31 is longer in the longitudinal direction X of the upper 3 than in the width direction Y of the upper 3 as shown in FIG. 1. This dimensional relationship is caused because the yarns 3*f* (see FIG. 4A to FIG. 4D) having a heat shrinkability are arranged substantially along the width direction Y (see FIG. 1) of the upper 3, which will be later described, then the upper is shaped by heating, and at the time of heating, the areas around the gaps 3K1 shrink more largely in the width direction Y than the longitudinal direction X.

The second layer 32 of this embodiment includes only the second yarns 3*s*. The second layer 32 is arranged inside the first layer 31 (on the side close to the foot of the wearer during the wearing, and on the lower side in FIG. 2A) when these layers are arranged in the upper 3. That is, the first layer 31 is an outer layer and the second layer 32 is an inner layer. The second layer 32 including only the second yarns 3*s* is located inside the upper 3, which gives a good touch feeling to the foot of the wearer of the shoe.

Here, at least either the first layer 31 or the second layer 32 may include the first yarns 3*f* and the second yarns 3*s* as the yarns for forming the knitted fabric. In this embodiment, the first layer 31 includes both yarns to meet this condition. Contrarily, only the second layer 32 may include both yarns (that is, the case where the first layer 31 includes only the second yarns 3*s*, while the second layer 32 includes the first layer 3*f* and the second layer 3*s*) to meet this condition. In this case, since the second layer 32 including the first yarns 3*f* having a heat shrinkability is located on the inner side of the upper 3, the upper 3 can be more easily conformed to the last 4 and shaped by heating when it is placed on the last 4 than the configuration in which a layer including the first yarns 3*f* is located on the outer side of the upper 3. Further, both of the first layer 31 and the second layer 32 may include both yarns to meet the condition.

In this embodiment, the first yarns 3*f* having a heat shrinkability included in the first layer 31 may be made of a core-sheath material that is formed by integrating a core 3*f*1 (inner circumference part) with a sheath 3*f*2 (outer circumference part) as schematically shown in FIG. 4A. On the other hand, the second yarns 3*s* are not made of the core-sheath material. The first yarns 3*f* are fusible yarns that are fused together by heating, and the core 3*f*1 and the sheath 3*f*2 have different fusion points. The sheath 3*f*2 has a lower fusion point than that of the core 3*f*1 in the first yarns 3*f*. Thus, it is possible to shrink the entirety of the first yarns 3*f*, while fusing only the sheaths 3*f*2 therein, by heating the unshaped upper 3A when the upper 3 is shaped. Thereby, both of the shape retaining action by the sheath 3*f*2 and the elastic action by the core 3*f*1 can be simultaneously provided. As the first yarns 3*f* having a heat shrinkability, for example, yarns including polyester resin can be used. More specifically, a core-sheath material including the core 3*f*1 and the sheath 3*f*2 both made of polyester thermoplastic elastomer, or a core-sheath material including the core 3*f*1 made of polyester thermoplastic elastomer and the sheath 3*f*2 made of polyamide thermoplastic elastomer can be used.

Figure 4C:
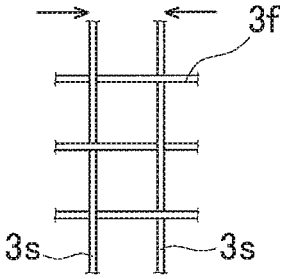
FIG. 4C is a schematic view showing a state in which first yarns are shrunk from the state of FIG. 4B.
Figure 4D:
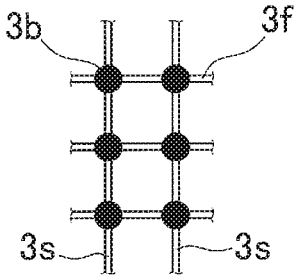
FIG. 4D is a schematic view showing a state in which the first yarns and second yarns are fused with each other from the state of FIG. 4C.

The layer (the first layer 31 in this embodiment) including the first yarns 3*f* having a heat shrinkability can be formed of knitted fabric, 10% or more of which is composed of the first yarns 3*f*. FIG. 4A to FIG. 4D schematically show a structure where the first yarns 3*f* and the second yarns 3*f* extend orthogonal to each other. In this schematically illustrated structure, the first yarns 3*f* extending in the horizontal direction of the drawing sheet are shrinked in the longitudinal direction as shown in FIG. 4C by heating the first layer 31. At this time, the shrinkage in the direction represented by the arrows changes the distance between the adjacent second yarns 3*s*, 3*s* extending in the longitudinal direction of the drawing sheet to thereby shorten the distance therebetween. The sheaths 3*f*2 of the first yarns 3*f* made of the core-sheath material are fused and fixedly attached to the second yarns 3*s* (at fixing points 3*b* shown as black circles in FIG. 4D). The first layer 31 is thus deformed. By utilizing this deformation, the upper 3 can be appropriately shaped to have a desired shape, specifically, to conform to the shape of the last (shoe last) 4.

Because the upper 3 can be easily conformed to the shape of the last 4, the upper 3 is not given such a shape as to cause a gap relative to the surface of the last on the lateral side of the foot. Thus, the foot of the wearer is less likely to move during the wearing of the shoe and thereby the upper 3 provides excellent holding properties. Further, there is no need to fill the caused gap with stuffing or fitting, and thus the feeling of wearing is good.

Also, the upper 3 can be formed into a three layer structure further including a third layer 33 arranged inside the second layer 32, as shown by dashed-two dotted lines in FIG. 2A. The third layer 33 can be formed of knitted fabric in the same manner as the first layer 31 and the second layer 32, or made of woven fabric. The weaving method for the woven fabric is not specifically limited, but may be plain-weaving or twill-weaving, for example. The third layer 33 preferably has a high shrinkability to exhibit larger shrinkage rate than the first layer 31 and the second layer 32. Here, the "shrinkage rate" is evaluated by the average values in the respective directions (for example, the average value in the direction X and the average value in the direction Y) of the entirety of each of the layers. As an example, high shrinkability can be imparted by making the fabric using spandex fiber, crimped textured yarn, stockinet stitch, neoprene material, or the like. According to this configuration, even after the first layer 31 and the second layer 32 are shrinked when the upper 3 is shaped by heating, the third layer 33 is hardly wrinkled because the third layer 33 follows the shrinkage due to the high shrinkability, so that the touch feeling of the foot of the wearer of the shoe can be improved. When the third layer 33 is thus provided, desired characteristics can be imparted to the produced shoe 1 by setting the material and the layer thickness of the third layer 33. The third layer 33 can be entirely or partly provided on the second layer 32. In the case where the third layer 33 is partly provided, the third layer 33 can be used, for example, to reinforce a peripheral edge of a wearing opening 11 through which the wearer places the foot into and out of the shoe, or to reinforce a part for installing an eyelet.

As the method for the reinforcement, sewing, needle punching, or hot melt sheet can be employed. The reinforcement is not limited to the upper 3 having a three layer structure with the third layer 33 arranged therein as described above, and may be applied to the upper 3 having a two layer structure composed of the first layer 31 and the second layer 32.

The upper 3 can include a body portion 34 located on the upper side in the vertical direction Z (see FIG. 1) after the unshaped upper 3A is sewn, and a bottom portion 35 continuous with the lower end of the body portion 34. The upper 3 can include only the body portion 34, while not including the bottom portion 35. Further, the bottom portion 35 that has been made can be removed later (separated from the body portion 34) as described later.

Figure 5:
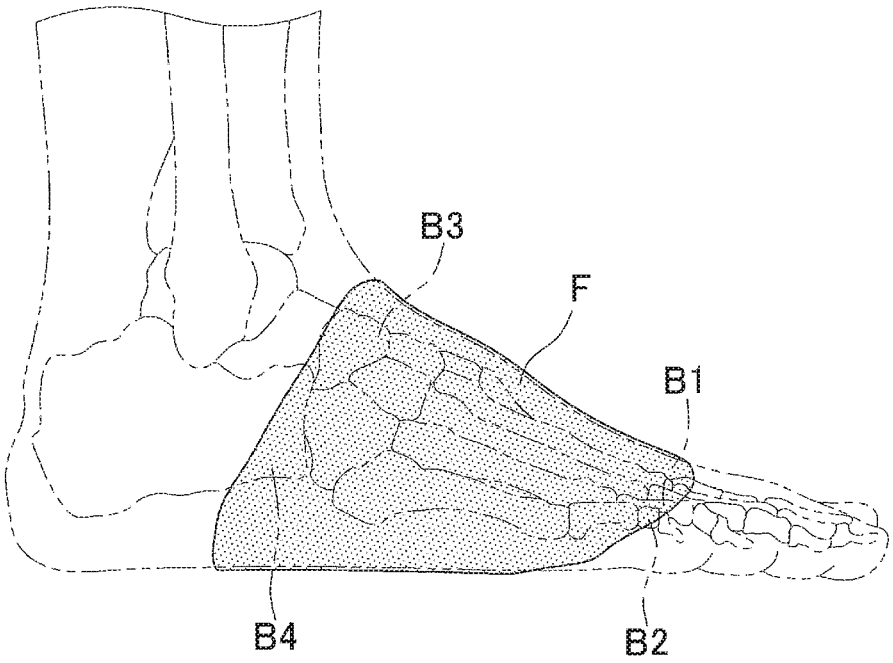
FIG. 5 is a side view showing a relationship between a forefoot part (shown by solid lines) and a structure of human foot anatomy (shown by two-dot chain lines).

The body portion can include a layer including the first yarns 3*f* and the second yarns 3*s* on at least an instep region of a forefoot portion. According to this configuration, the moldability of the instep region of the upper 3 can be improved. Herein, the "forefoot portion" is intended to be a portion of the human foot anatomy as encircled in FIG. 5, that is, an area from the proximal phalanx B1 of the fingers (the middle phalanx B2 for the fifth finger) to the anterior parts of the talus B3 and the calcaneus B4, and corresponding to the aforementioned area of the wearer's foot anatomy in the body portion 34 of the upper 3 during the wearing. The "instep region" is a region of the forefoot portion F in contact with the instep of the wearer, and is located on the upper side of the portion encircled in FIG. 5. The forefoot portion F is an important portion because it has great influence on the feeling of wearing or the athletic performance of the wearer during the wearing. Therefore, a great effect corresponding to the aforementioned influence can be obtained by reliably conforming the shape of the instep region of the forefoot portion F to the last 4.

Figure 2B:
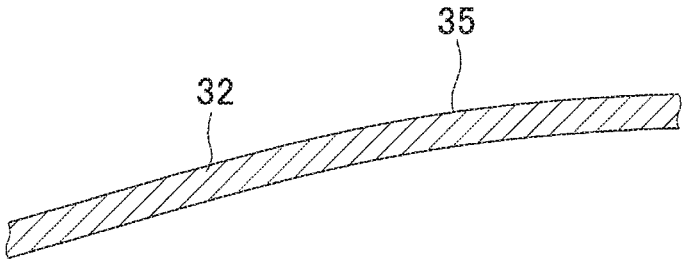
FIG. 2B is a cross-sectional view showing an example of a layer structure of a bottom portion of the upper in a portion surrounded by circle B in FIG. 1.

When the upper 3 includes the bottom portion 35, at least a part of the body portion 34 may have a multilayer structure (a two layer structure (shown by solid lines) or a three layer structure (additionally shown in dashed two doted lines) in this embodiment) including both of the first yarns 3*f* and the second yarns 3*s* as shown in FIG. 2A, while the bottom portion 35 may have a single layer structure of only the second layer 32 without providing a layer including both of the first yarns 3*f* and the second yarns 3*s* as shown in FIG. 2B. That is, the bottom portion 35 may not include the first yarns 3*f* having a heat shrinkability. This configuration enables the bottom portion 35 to be hardly deformed when the upper 3 is shaped by heating. By configuring the bottom portion 35 to be hardly deformed, the bottom portion 35 can be easily adjusted in position relative to the sole 2. Thus, the sole 2 and the upper 3 can be reliably adhered to each other with accurate positioning therebetween.

Contrary to the above, the bottom portion 35 may include the first layer 31. In this case, an additional layer may be further provided inside the first layer 31 (a layer similar to the third layer 33 of the body portion 34 shown in FIG. 2A). This configuration enables the additional layer to suppress the deformation when the upper 3 is shaped by heating. Thus, the bottom portion 35 is hardly deformed.

Next, the description will be made for a method for producing the shoe 1 provided with the upper 3 including the first layer 31 and the second layer 32 layered on the first layer 31. This production method mainly includes a cutting step, a joining step, a first shaping step, a second shaping step, and a sole attaching step. In addition to the above, further steps can be appropriately added.

Figure 6:
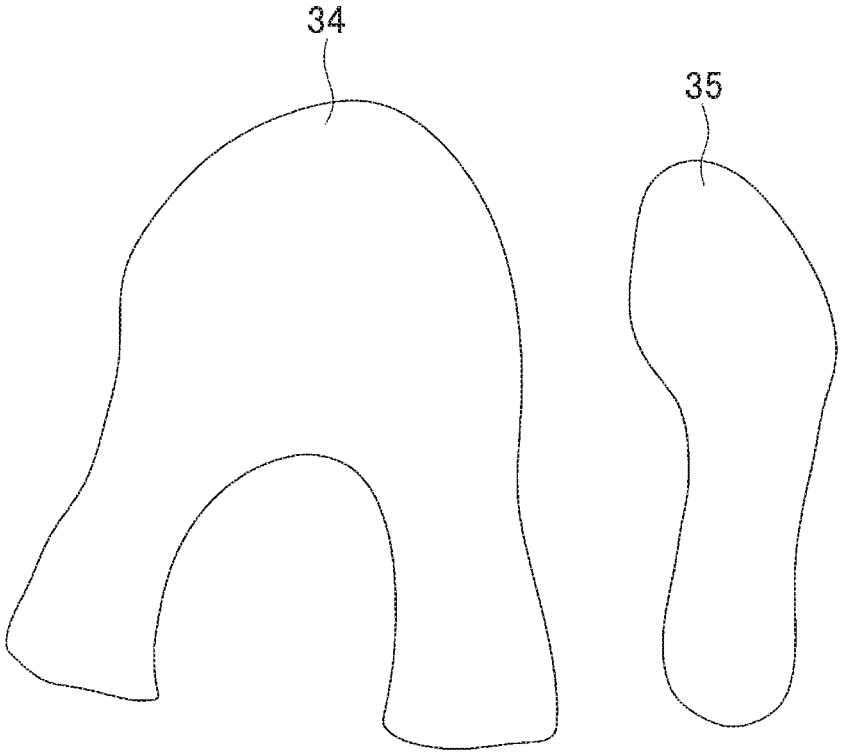
FIG. 6 is a plan view showing the body portion (opening areas are not shown) and the bottom portion which are materials of the upper in a state after a cutting process.
Figure 7:
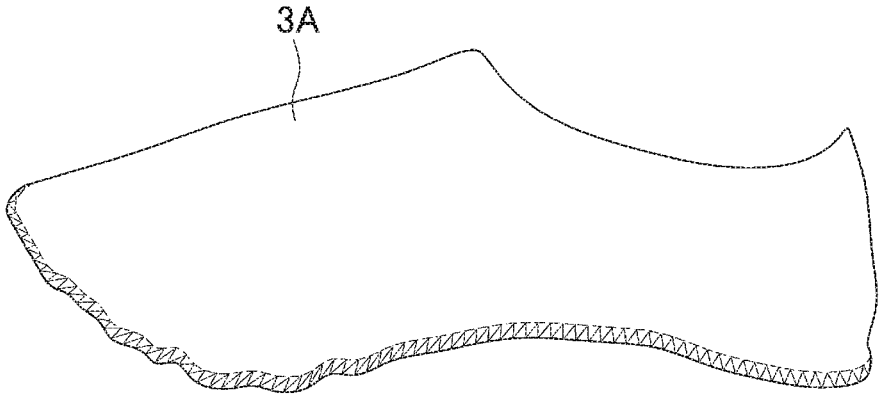
FIG. 7 is a side view showing an unshaped upper with the body portion (opening areas are not shown) and the bottom portion sewn together.
Figure 8:
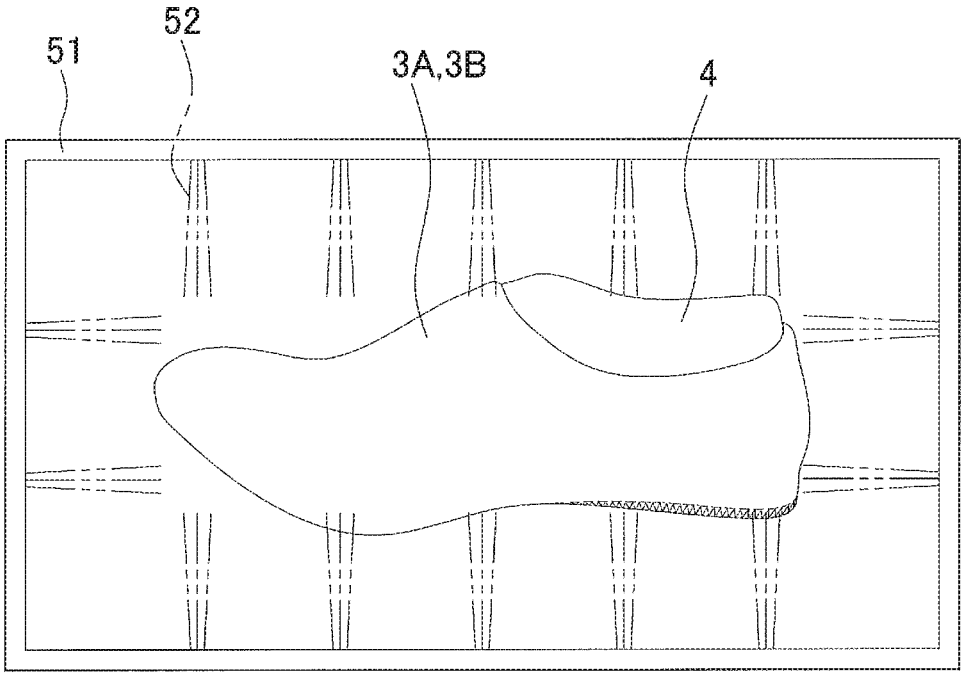
FIG. 8 is a side view showing a state in which the unshaped upper (opening areas are not shown) is placed on a last and steam heated in a heating box.

In the cutting step, the first layer 31 and the second layer 32 each having a sheet shape are cut into certain sizes and shapes to have the shapes as shown in FIG. 6 in which the body portion 34 and the bottom portion 35 are developed. In the joining step, the first layer 31 and the second layer 32 are layered and joined together, for example, by sewing at least the outer edges of the layers 31, 32 to make an unshaped upper 3A having a shape corresponding to the upper 3 (see FIG. 7). The order of the cutting step and the joining step is not limited to this and may be reversed. For example, the unshaped upper 3A may be made by integrally knitting or weaving the first layer 31 and the second layer 32. The first layer 31 and the second layer 32 may be integrally knitted, while gaps are provided therebetween. In this case, the joining step (i.e., the step of making the layers 31, 32 also serves as the joining step) is performed prior to the cutting step. Further, in this case, not only the outer edges but also the entirety of the layers 31, 32 are joined. In the joining step, a cushion material or a reinforcement material may be appropriately inserted between the first layer 31 and the second layer 32. In the first shaping step, the unshaped upper 3A is placed on the last 4 (see FIG. 8). In the second shaping step, the unshaped upper 3A is deformed to conform to the shape of the last 4 by heating from a peripheral area of the unshaped upper 3A, to make a shaped upper 3B (see FIG. 1). The heating temperature and the heating time in the second shaping step can be appropriately set in accordance with the configuration of the unshaped upper 3A. The heating means used in the second shaping step is steam heating. As schematically shown in FIG. 8, for example, the unshaped upper 3A is stored in a heating box 51 and heated by vapor 52 at a high temperature discharged from an inner surface of the heating box 51. The entirety of the unshaped upper 3A can be evenly heated by steam heating. Thus, the unshaped upper 3A can be uniformly deformed to conform to the last 4 to obtain the shaped upper 3B. Other than the steam heating, for example, hot air heating or hot water heating can be employed in the second shaping step. Further, the unshaped upper 3A can be partly heated instead of being heated entirely. In the sole attaching step, the shaped upper 3B is attached to the sole 2 that has been made separately, for example, by adhesion. Other than adhesion, the sole attaching step can be performed simultaneously with the second shaping step by heat fusion, for example.

The shoe 1 is produced by taking a series of the aforementioned steps. Forming a shoe tongue, processing the wearing opening 11, installing eyelets for putting a shoelace (shoestring) therethrough, decorating with ornaments or tags, printing a logo, or attaching an insole (sockliner) may be appropriately performed during any of these steps or after all the steps have been finished.

The unshaped upper 3A has a mesh structure formed of the knitted fabric that is included in each of the first layer 31 and the second layer 32, and one of the first layer 31 and the second layer 32, which includes both of the first yarns 3*f* and the second yarns 3*s*, has a gap ratio greater than the other layer (the layer that does not include both of the first yarns 3*f* and the second yarns 3*s*). The "gap ratio" means a ratio of the area of gaps (openings) to the area of knitted fabric when the knitted fabric of the layers 31, 32 are viewed in plan view. By thus configuring the layer including the first yarns 3*f* and the second yarns 3*s* to have a gap ratio greater than the other layer, shrinkage of the unshaped upper 3A when the upper 3 is shaped by heating is hardly blocked, and the shaped upper 3B can be appropriately made in the second shaping step.

When the unshaped upper 3A includes the body portion 34 located on the upper side and the bottom portion 35 continuous with the lower end of the body portion 34, the bottom portion 35 can avoid application of heat in the second shaping step. In order not to apply the heat to the bottom portion 35, for example, a jig such as a shield having heat insulating properties, or the last 4 having heat insulating properties on its bottom surface can be used so that the heat reaching the bottom portion 35 can be reduced. Thus, the bottom portion 35 is hardly deformed when it is heated. Therefore, the bottom portion 35 can be precisely adhered to the sole 2 in the adhering step.

Separately from the aforementioned description, when the body portion 34 located on the upper side and the bottom portion 35 continuous with the lower end of the body portion 34 are provided, a bottom portion removing step for removing the bottom portion 35 by applying the heat to the bottom portion 35 in the second shaping step can be included after the second shaping step. In the bottom portion removing step, the bottom portion 35 having a shape as shown in the right side of FIG. 6 is removed from the body portion 34 to form a through hole (not shown) on the lower side of the shaped upper 3B. The edge of the through hole of the shaped upper 3B subjected to the bottom portion removing step is attached to the sole 2. The unshaped upper 3A is reliably conformed to the shape of the last 4 in the second shaping step, and thereafter the bottom portion 35, which is likely to be hardened by heat shrinking when it is adhered to the sole 2, is removed from the shaped upper 3B. Thereby, the shoe 1 including the sole 2 having an appropriate hardness can be produced with the sole 2 subjected to no influence from the heated bottom portion 35.

Even in the case where the heat is not applied to the bottom portion 35 as described above, the bottom portion 35 may be hardened when the adhesive agent is applied to the bottom portion 35. Thus, the bottom portion removing step may be performed even when the heat is not applied to the bottom portion 35.

According to the production method of this embodiment, the upper 3 is easily conformed to the shape of the last 4 when the upper 3 is shaped in the second shaping step. Thus, the shoe 1 that is conformed to the shape of the last 4 can be produced.

Hereinafter, configurations according to the embodiment of the present application and effects produced thereby will be summarized. The shoe of this embodiment includes an upper that includes: a first layer made of knitted fabric; and a second layer made of knitted fabric arranged inside the first layer, wherein at least one of the first layer and the second layer includes first yarns and second yarns as yarns for forming the knitted fabric, wherein the first yarns have a heat shrinkability, wherein the second yarns have a higher fusion point than that of the first yarns, and wherein the at least one of the first layer and the second layer including the first yarns and the second yarns has a higher heat shrinkage rate in a width direction than in a longitudinal direction.

According to this configuration, by providing the layer including the first yarns having a heat shrinkability, the layer including the first yarns and the second yarns is easily deformed when the upper is shaped by heating, so that the upper is easily conformed to the shape of the last.

It may be configured such that the first layer includes the first yarns and the second yarns, the second layer includes only the second yarns, and the heat shrinkage rate of the first yarns is two times or more the heat shrinkage rate of the second yarns.

According to this configuration, the ratio of the heat shrinkage rate of the first yarns to the heat shrinkage rate of the second yarns can be appropriately set, which enables to easily mold the upper by heating. Further, the second layer including only the second yarns is located inside the upper, which gives a good touch feeling to the foot of the wearer of the shoe.

It may be configured such that the first layer includes only the second yarns, the second layer includes the first yarns and the second yarns, and the heat shrinkage rate of the first yarns is two times or more the heat shrinkage rate of the second yarns.

According to this configuration, the ratio of the heat shrinkage rate of the first yarns to the heat shrinkage rate of the second yarns can be appropriately set, which enables to easily mold the upper by heating. Further, the second layer including the first yarns is located inside the upper, so that the upper is more easily conformed to the last when the upper is placed on the last.

It may be configured such that the knitted fabric that forms at least the first layer includes certain gaps opening through its surface, and a size of the gaps is longer in the longitudinal direction of the upper than in the width direction of the upper.

According to this configuration, the thus provided gaps can impart breathability and flexibility to the upper. Further, margins to shrink when the upper is shaped by heating are reliably provided in the upper.

It may be configured such that the upper includes a third layer arranged inside the second layer, wherein the third layer has a higher shrinkability than the first layer and the second layer.

According to this configuration, because of the good shrinkability of the third layer, the third layer is hardly wrinkled even after the upper is shaped by heating, so that an improved touch feeling can be given to the foot of the wearer of the shoe.

It may be configured such that the upper includes a body portion located on an upper side and a bottom portion continuous with a lower end of the body portion, and the body portion includes a layer including the first yarns and the second yarns in at least an instep region of a forefoot portion.

According to this configuration, the moldability of the instep region of the upper can be improved.

It may be configured such that the upper includes a body portion located on an upper side and a bottom portion continuous with a lower end of the body portion, the body portion includes a layer including the first yarns and the second yarns in at least a part thereof, and the bottom portion does not include a layer including the first yarns and the second yarns.

According to this configuration, the bottom portion is hardly deformed when the upper is shaped by heating.

The first yarns may be made of a core-sheath material.

According to this configuration, both of the shape retaining action by a sheath portion and the elastic action by a core portion can be simultaneously provided.

The method for producing a shoe of this embodiment is a method for producing a shoe that is the aforementioned shoe including: a joining step of joining the first layer and the second layer at least along outer edges of the first layer and the second layer to make an unshaped upper; a first shaping step of placing the unshaped upper on a last; and a second shaping step of heating the unshaped upper to make it conform to a shape of the last to thereby provide the shaped upper.

According to this configuration, a shoe that is conformed to the last can be produced.

A heating means used in the second shaping step may be steam heating.

According to this configuration, the entirety of the unshaped upper can be evenly heated.

It may be also configured such that the unshaped upper has a mesh structure formed of the knitted fabric included in the first layer and the second layer, and, and a gap ratio of one of the first layer and the second layer including the first yarns and the second yarns is greater than a gap ratio of the other layer.

According to this configuration, the layer including the first yarns 3*f* and the second yarns 3*s* is configured to have a gap ratio greater than the other layer, so that the shrinkage of the unshaped upper when the upper is shaped by heating is hardly blocked and the shaped upper can be appropriately made in the second shaping step.

It may be configured such that the unshaped upper includes a body portion located on an upper side and a bottom portion continuous with a lower end of the body portion, the method including a bottom portion removing step of removing the bottom portion after the second shaping step.

According to this configuration, the unshaped upper is conformed to the shape of the last in the second shaping step, and thereafter the bottom portion, which is likely to be hardened by heating when it is adhered to the sole, is removed from the shaped upper. Thereby, the shoe including the sole having an appropriate hardness can be produced.

According to this embodiment, the upper is easily conformed to the shape of the last when the upper is shaped by heating. Therefore, it is possible to provide a shoe including an upper that is easily conformed to the shape of a last when it is shaped, and a method for producing the shoe.

The present invention is described above by way of embodiments, but the foregoing description is merely an example. The shoe 1 and the method for producing the shoe 1 according to the present invention are not limited to the aforementioned embodiments. Thus, the shoe 1 and the method for producing the shoe 1 according to the present invention can be subjected to various modifications within the gist of the present invention. Such modifications include, for example, replacement of a part or omission of a part of a plurality of elements constituting the aforementioned embodiments, or appropriate combination of elements belonging to the separate examples. Further, the matters belonging to the common technical knowledge in relation to the shoe 1 or the method for producing the shoe 1 are also included.

REFERENCE SIGNS LIST

1: Shoe
11: Wearing opening
2: Sole
3: Upper
31: First layer
32: Second layer
33: Third layer
34: Body portion
35: Bottom portion
3A: Unshaped upper
3B: Shaped upper
3*f*: First yarn
3*f*1: Core of core-sheath material
3*f*2: Sheath of core-sheath material
3*s*: Second yarn
3*b*: Fixing point
3*k*: Knitted fabric having gaps
3*k*1: Gap
4: Last
F: Forefoot portion

The invention claimed is:

1. A shoe comprising:

an upper that comprises a first layer made of a first knitted fabric and a second layer made of a second knitted fabric arranged inside the first layer, wherein at least one of the first layer comprises first yarns and second yarns which form the first knitted fabric, and the second layer comprises the first yarns and the second yarns which form the second knitted fabric, wherein the first yarns and the second yarns have a heat shrinkability, the second yarns have a higher fusion point than that of the first yarns, the at least one of the first layer and the second layer comprising the first yarns and the second yarns has a higher heat shrinkage rate in a width direction than in a longitudinal direction, and the first yarns have a heat shrinkability greater than the second yarns.

2. The shoe according to claim 1, wherein the first layer comprises the first yarns and the second yarns, the second layer comprises the second yarns and is without the first yarns, and the heat shrinkage rate of the first yarns is two times or more the heat shrinkage rate of the second yarns.

3. The shoe according to claim 1, wherein the first layer comprises the second yarns and is without the first yarns, the second layer comprises the first yarns and the second yarns, and the heat shrinkage rate of the first yarns is two times or more the heat shrinkage rate of the second yarns.

4. The shoe according to claim 1, wherein the first knitted fabric that forms the first layer is configured with first gaps opening through a surface of the first knitted fabric, and a size of the first gaps is longer in the longitudinal direction of the upper than in the width direction of the upper.

5. The shoe according to claim 1, wherein the upper comprises a third layer arranged inside the second layer, and the third layer has a higher shrinkability than the first layer and the second layer.

6. The shoe according to claim 1, wherein the upper comprises a body portion located on an upper side and a bottom portion continuous with a lower end of the body portion, and the body portion comprises one of the first layer or the second layer comprising the first yarns and the second yarns in at least an instep region of a forefoot portion.

7. The shoe according to claim 1, wherein the upper comprises a body portion located on an upper side and a bottom portion continuous with a lower end of the body portion, and the body portion comprises one of the first layer or the second layer comprising the first yarns and the second yarns in at least a part thereof.

8. A method for producing the shoe according to claim 1, the method comprising:

joining the first layer and the second layer at least along outer edges of the first layer and the second layer to make an unshaped upper;

placing the unshaped upper on a last; and heating the unshaped upper to conform the unshaped upper to a shape of the last to provide the shaped upper.

9. The method according to claim 8, wherein the heating is performed by steam heating.

10. The method according to claim 8, wherein the unshaped upper has a mesh structure formed of the knitted fabric included in the first layer and the second layer, and a gap ratio of one of the first layer and the second layer comprising the first yarns and the second yarns is greater than a gap ratio of the other of the first layer and the second layer.

11. The method according to claim 8, wherein the unshaped upper comprises a body portion located on an upper side and a bottom portion continuous with a lower end of the body portion, and the method further comprises removing the bottom portion after the heating.

12. The shoe according to claim 2, wherein the first knitted fabric that forms the first layer is configured with first gaps opening through a surface of the first knitted fabric, and a size of the first gaps is longer in the longitudinal direction of the upper than in the width direction of the upper.

13. The shoe according to claim 3, wherein the first knitted fabric that forms the first layer is configured with first gaps opening through a surface of the first knitted fabric, and a size of the first gaps is longer in the longitudinal direction of the upper than in the width direction of the upper.

14. The shoe according to claim 2, wherein the upper comprises a third layer arranged inside the second layer, and the third layer has a higher shrinkability than the first layer and the second layer.

15. The shoe according to claim 3, wherein the upper comprises a third layer arranged inside the second layer, and the third layer has a higher shrinkability than the first layer and the second layer.

16. The shoe according to claim 4, wherein the upper comprises a third layer arranged inside the second layer, and the third layer has a higher shrinkability than the first layer and the second layer.

17. The shoe according to claim 2, wherein the upper comprises a body portion located on an upper side and a bottom portion continuous with a lower end of the body portion, and the body portion comprises one of the first layer or the second layer comprising the first yarns and the second yarns in at least an instep region of a forefoot portion.

18. The shoe according to claim 3, wherein the upper comprises a body portion located on an upper side and a bottom portion continuous with a lower end of the body portion, and the body portion comprises one of the first layer or the second layer comprising the first yarns and the second yarns in at least an instep region of a forefoot portion.

19. The shoe according to claim 4, wherein the upper comprises a body portion located on an upper side and a bottom portion continuous with a lower end of the body portion, and the body portion comprises one of the first layer or the second layer comprising the first yarns and the second yarns in at least an instep region of a forefoot portion.

* * * * *